United States Patent [19]

Corthell

[11] 4,013,921

[45] Mar. 22, 1977

[54] WARNING LIGHT CONTROL

[75] Inventor: William I. Corthell, East Haddam, Conn.

[73] Assignee: Austin Electronics, Inc., Deep River, Conn.

[22] Filed: June 2, 1975

[21] Appl. No.: 582,654

[52] U.S. Cl. ..... 315/241 R; 315/209 CD; 315/209 SC; 315/239; 315/241 P

[51] Int. Cl.[2] ..... H05B 37/00; H05B 39/00; H05B 41/14

[58] Field of Search ..... 315/241 P, 241 S, 241 R, 315/209 R, 239, 209 SC, 209 M, 209 CD

[56] References Cited

UNITED STATES PATENTS

| | | | |
|---|---|---|---|
| 2,977,508 | 3/1961 | Germeshausen | 315/241 S |
| 3,171,057 | 2/1965 | Buckingham | 315/241 P |
| 3,286,128 | 10/1966 | Ward | 315/241 |
| 3,316,445 | 4/1967 | Ahrons | 315/241 P |
| 3,443,154 | 5/1969 | Hoekstra et al. | 315/241 R |
| 3,886,436 | 5/1975 | Wadlington | 315/241 P |
| 3,898,514 | 8/1975 | Takahashi | 315/241 P |

OTHER PUBLICATIONS

Inside The Electronic Photoflash, Radio Electronics, Mar., 1961 pp. 36–39.

*Primary Examiner*—Saxfield Chatmon, Jr.

[57] ABSTRACT

The visibility of warning lights employing flash tubes is enhanced by control circuitry which generates closely spaced trigger pulse pairs for energizing the tubes to thereby produce double flashes. Noticeability of the warning light may be enhanced by addition thereto of a noise maker which operates off the same power supply that provides a high voltage for operating the flash tube or tubes.

8 Claims, 2 Drawing Figures

TIMER
26
C6
C5
R10
R9
ZD3
R11
D5
D4
R14
R13'
R13
SCR-1
R12
D6
SCR2
R12'
R14'
C7
C7'
24
12
14
10
Q5
ZD2
Q4
D3
R8
ZD1
Q3
R5
R6
R7
C1
C2
Q2
R1'
D2'
D1'
R2'
Q1
R1
D2
D1
R2
16
T1
18
20
C3
C4
R4
R3
22
T2
28
C8
S1

WARNING LIGHT CONTROL

BACKGROUND OF THE INVENTION

1. Field of the Invention

The present invention relates to electronically energized light emitters and particularly to control circuits for generating trigger pulses for application to gaseous discharge tube devices. More specifically, this invention is directed to enhancement of the noticeability of warning devices such as, for example, those which employ repetitively energized flash tubes. Accordingly, the general objects of the present invention are to provide novel and improved apparatus and methods of such character.

2. Description of the Prior Art

While not limited thereto in its utility, the present invention has been found to be particularly well suited for use with and/or as a warning device. Warning devices employing Xenon flash tubes are well known in the art and find application on emergency vehicles, aircraft and in other installations where it is considered necessary or desirable to attract attention by means of the generation of intermittent bursts of energy in the visible range of the frequency spectrum. It is generally accepted that electronic flash tubes, such as the aforementioned Xenon tubes, are more readily visible than previous mechanically energized oscillating and rotating beacon type devices. Nevertheless, for some time it has been desired to enhance the attention gathering properties of warning lights employing flash tubes.

For a disclosure of a typical prior art technique for the periodic energization of devices such as gaseous discharge tubes employed as light generators, reference may be had to U.S. Pat. No. 3,515,973 which is assigned to the assignee of the present invention. Power supplies of the type exemplified by U.S. Pat. No. 3,515,973 generate, from a low voltage source, a high voltage which is applied to a capacitive discharge circuit across which the flash tube is connected. The power supply circuits further generate trigger pulses which control the discharge of energy from such capacitive discharge circuits through the flash tube when it is desired to produce a light pulse. The discharge time; i.e., the length of the light pulse produced; is comparatively short and thus the visibility thereof is somewhat limited in spite of the fact that the intensity of the light generated is extremely high. Additionally, with prior art power supplies for flash tubes, the duty cycle is very low. That is, the dwell time between generation of successive trigger pulses constitutes the major portion of the operational cycle.

It has been long recognized, for example as observed in U.S. Pat. No. 3,430,102, that the visibility of a warning light could be enhanced by causing a lamp to "flash" twice in rapid succession. If a pair of flashes in rapid succession were to be produced, the lamp could appear, as a consequence of the retention characteristics of the human eye, to provide a single flash of long duration. Such a "lengthened" output pulse would, of course, have enhanced visibility in comparison to a single light flash of shorter duration.

It is also well known that a discernable double flash enhances visibility. This is particularly true in the case of moving objects where tests have shown that an observer may fix the position of such objects much more readily when two flashes occur in rapid succession than with a single flash followed by the customary delay until a succeeding flash is produced.

If a warning light is to be a commericially viable product, it is necessary that it be characterized by control circuitry which is designed to operate reliably in a rather harsh environment while simultaneously being economical to produce. There has not previously been available an economic and reliable circuit for producing trigger pulse pairs with adjustable timing for use in the firing of gaseous discharge tubes, and particularly Xenon flash tubes, to thereby permit generation of either an apparent long duration flash, a pair of discernable flashes closely spaced in time or a pattern of "double" flashes.

In addition to enhancement of the visibility of warning lights, it is in many instances considered desirable to further augment the attention gathering capability of warning light devices by some auxiliary means. Thus, by way of example, the requirements of the Occupational Safety and Health Act of 1970 have required that devices such as electric trucks for use in factory areas be provided with both visible warning beacons and some form of noise maker which is energized when the vehicle is placed in reverse gear. At the present time separate power supply circuits are employed for energization of the warning beacon and the sound generator. Such use of separate power supplies, of course, increases cost and reduces the reliability of the apparatus. It would thus be desirable to employ the same power supply used to intermittently energize a flash tube type warning light to simultaneously intermittently energize a suitable noise maker to thereby produce pulses of light and sound.

SUMMARY OF THE INVENTION

The present invention overcomes the above briefly discussed and other deficiencies and disadvantages of the prior art by providing a novel and improved method and apparatus for controlling warning devices including flash tube type light sources.

In accordance with a first embodiment of the invention a novel high voltage switching circuit including timing logic permits the generation of pairs of trigger pulses for energizing a flash tube. By means of varying the dwell time between output pulses provided by a timer, trigger pulse spacing may be controlled to produce the effect of a light flash of increased duration or a pair of closely spaced but individually discernable flashes may be generated. Each of the trigger pulses is generated by establishing a discharge path for a capacitor connected in a series resonant circuit.

Pursuant to a second embodiment, a plurality of flash tubes may be energized by multiple trigger pulse pairs generated by logic circuitry.

Also in accordance with the invention, an audible warning device may be operated off of the same power supply employed to generate the high voltage utilized to energize the flash tube or tubes. The audible warning includes an electro-mechanical noise maker which is supplied with current at the frequency of conversion of the low voltage source into the requisite high voltage for the flash tube or tubes.

BRIEF DESCRIPTION OF THE DRAWINGS

The present invention may be better understood and its numerous objects and advantages will become apparent to those skilled in the art by reference to the accompanying drawing wherein like reference numerals refer to like elements in the figures and in which.

DESCRIPTION OF THE PREFERRED EMBODIMENT

Figure 1:
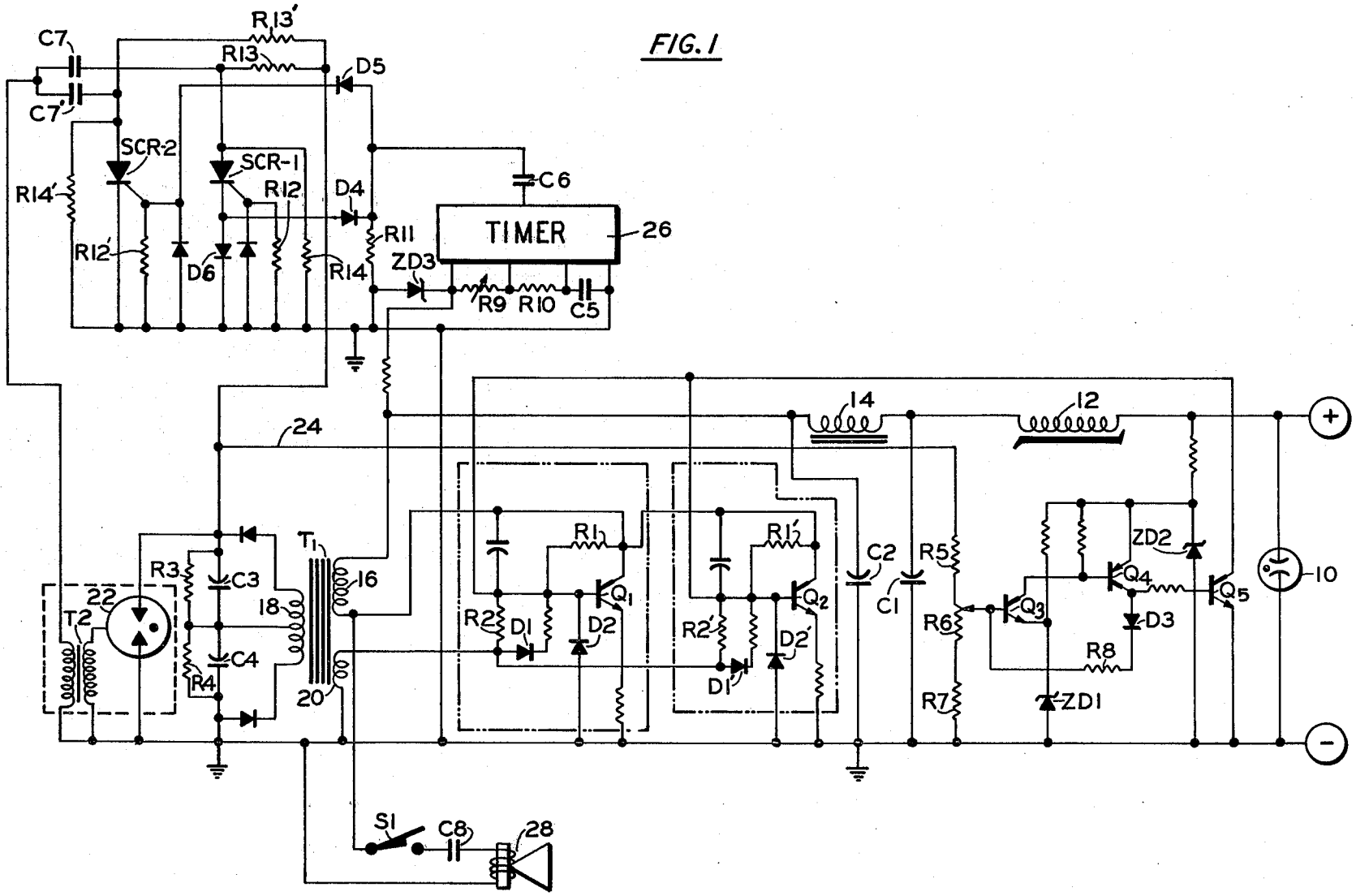
FIG. 1 is a schematic diagram of a preferred embodiment of a power supply and control circuit in accordance with the present invention.

With reference to FIG. 1, power for operating the control circuit is supplied by a direct current source, not shown, connected across a transient protector 10 which is typically be a xenon spark gap. A positive terminal of the DC source is coupled, by a pair of series connected choke coils 12 and 14, to the first end of a primary winding 16 of a non-saturating transformer T1. Transformer T1 also includes a center tapped secondary winding 18 and a feedback winding 20. Transformer T1, in combination with a blocking oscillator including parallel connected transistors Q1 and Q2, forms a "ringing choke" or "fly-back" static inverter. The inductors 12 and 14 cooperate with a pair of capacitors C1 and C2 to define a line filter. The purpose of this line filter is to keep the inverter from modulating the low voltage supply at the frequency of conversion and to simultaneously isolate the inverter from line transients.

Static inverters employing blocking oscillators are well known in the art and thus the operation of the parallel connected transistor switches Q1 and Q2 will be described out briefly herein. The positive potential of the DC source will be applied to the collectors of transistors Q1 and Q2 via primary winding 16 of transformer T1. Continuing with a discussion only of the operation of the circuit including transistor Q1, a voltage divider consisting of resistors R1 and R2 will provide a starting bias which is applied to the base of transistor Q1. At this point it is to be noted that resistor R2 is connected to a negative terminal of the DC source through feedback winding 20 of transformer T1. Upon application of the positive supply potential to its collector and the starting bias to its base, transistor Q1 will be rendered conductive with current being supplied through primary winding 16 of transformer T1. The current drawn by transistor Q1 will increase linearly with base drive for transistor Q1 being supplied via the voltage divider R1, R2 and also from feedback winding 20 of transformer T1 via diode D1. There is a peak value of current through transistor Q1 which can be supported by the forward bias on the transistor even with the additional base drive supplied through diode D1. When this peak value is reached and the current flow can no longer be sustained, the current will begin to decrease, the forward bias on the transistor will simultaneously decrease and the field about primary winding 16 will collapse. When the field begins to collapse transistor Q1 will be deprived of the additional base drive from feedback winding 20 via diode D1 and the forward bias will rapidly decrease to the point where transistor Q1 is turned off.

Thus, to summarize, transistor Q1 functions as a switching device which permits the current flow through primary winding 16 of transformer T1 to increase linearly to a peak value and, when this peak value is reached, the current flow will rapidly decrease and the field about winding 16 will rapidly collapse. Diode D2 is connected between the base of transistor Q1 and the negative side of the DC power source to protect the base-emitter junction of transistor Q1 from the reverse voltage induced in feedback winding 20 when the field about primary winding 16 collapses. The switching circuit including transistor Q2 is identical to and parallel with the circuit including transistor Q1 and transistors Q1 and Q2 are matched and in parallel so that they will equally divide the primary winding current of transformer T1.

When the field about primary winding 16 of transformer T1 collapses, energy will be transferred to secondary winding 18 and will be stored in capacitors C3 and C4. Capacitors C3 and C4 will be discharged through the load, which is shown as being a xenon flash tube 22, upon the generation of trigger pulses in the manner to be described below. Resistors R3 and R4 are respectively connected in parallel with capacitors C3 and C4 to provide for the bleeding off of the charge on these capacitors when the circuit is not in use; i.e., resistors R3 and R4 are included in the circuit to minimize potential shock hazard to service personnel.

The embodiment of FIG. 1 further comprises a voltage sensitive shut-off circuit including normally nonconductive transistors Q3, Q4 and Q5. Transistors Q3 and Q4 define a Schmitt trigger circuit. The high output voltage developed across series connected capacitors C3 and C4 is applied, via conductor 24, to a voltage divider comprised of series connected resistors R5, R6 and R7; resistor R6 being a variable resistance. The voltage appearing at the wiper arm of variable resistor R6 is applied to the base of transistor Q3. The emitter of transistor Q3 is connected to ground via a Zener diode ZD1; diode ZD1 thus establishing a reference voltage for the turning on of transistor Q3. When the high output voltage applied to conductor 24 exceeds a preselected level, transistor Q3 will be biased into conduction with the base-emitter current initially being supplied from the voltage divider R5, R6 and R7. When transistor Q3 becomes conductive current will be drawn through the base-emitter junction of transistor Q4 thus also turning on transistor Q4. The conduction of transistor Q4 will supply additional base-emitter current for transistor Q3 via a feedback circuit consisting of diode D3 and resistor R8. Thus, in the customary manner of operation of a Schmitt trigger circuit, transistor Q3 will be locked in the conductive condition when its base voltage exceeds a reference established by the setting of variable resistance R6 and by Zener diode ZD1; conduction of Q3 indicating that the voltage across capacitors C3 and C4 has exceeded a preselected level indicative of, for example, a failure of flash tube 22. The conduction of transistor Q4 will drive transistor Q5 into saturation. Conduction of transistor Q5 will shunt off all base drive to switching transistors Q1 and Q2 thus disabling the static inverter.

As the voltage on conductor 24 decreases, the base-emitter drive for transistor Q3 will similarly decrease and ultimately there will be insufficient drive to maintain transistor Q3 in the conductive state; i.e., when the high voltage falls to a sufficiently low level the current feedback from transistor Q4 will be insufficient to hold the Schmitt trigger in the conductive condition. It is to be observed that the turn-off voltage for the Schmitt trigger will be at a level which is substantially below that which initially causes conduction of transistor Q3. This feature will permit continued operation with, for example, the embodiment of FIG. 2 where a plurality of flash tubes are energized from the same power source and only one of such flash tubes fails thus causing the high voltage to periodically rise above the shut-off level. The Zener diode ZD2 connected in parallel with the Schmitt trigger circuit permits the operation of the shut-off circuit to be independent of line voltage.

The circuit for generating trigger pulses which control the discharge of capacitors C3 and C4 through the flash tube load consists of a logic section and a high voltage switching section. The logic section comprises a monolithic timing circuit 26 which may, for example, be a Signetics Corporation type NE555V timer. Timing circuit 26 provides an output square wave with an adjustable duty cycle. A variable bias voltage developed across an RC circuit comprised of resistors R9 and R10 and capacitor C5 controls the "on" and "off" times of the output of timer 26. Thus, when capacitor C5 charges to the threshold voltage level of the timer, the output of the timing circuit will go negative and will stay negative for a portion of the cycle determined by the discharge time of C5; i.e., the duration of the negative portion of each cycle of the square wave will be a function of the time constant of the timing circuit including resistor R10 and capacitor C5. A Zener diode ZD3 is included to provide voltage protection for timing circuit 26.

The square wave output of timing circuit 26 is coupled, via capacitor C6, to the input of the high voltage switching circuit which generates trigger pulses for flash tube 22. A resistor R11 connected across the input to the trigger pulse generation circuitry forms, in cooperation with capacitor C6, a differentiator whereby negative and positive pulses respectively synchronized with the trailing and leading edges of each positive half-cycle of the timing circuit output square wave will be generated.

The negative pulses appearing at the output of the differentiator are coupled, via diode D4, to the cathode of a first silicon controlled rectifier SCR-1. The positive going output pulses from the differentiator are applied, via diode D5, to the gate electrode of a second silicon controlled rectifier SCR-2. Considering the operation of the rectifier device SCR-1, it is to be noted that SCR-1 has a "fixed gate"; i.e., the gate electrode of SCR-1 is connected to ground via a resistor R12. Accordingly, application of a negative going pulse to the cathode of SCR-1 will result in the gate junction of this device effectively assuming a positive potential with respect to ground and, accordingly, SCR-1 will be forward biased and will conduct. A diode D6, connected between the cathode of SCR-1 and ground, becomes forward biased during conduction of SCR-1 and completes the forward conduction path for the rectifier. Diode D6 also prevents the negative pulses applied to the cathode of SCR-1 from being shorted to ground. Resistors R13 and R14; resistor R14 being connected between the anode of SCR-1 and ground; define a voltage divider which provides proper bias voltage for operation of SCR-1.

The voltage appearing at the anode of SCR-1 when the rectifier device is in the non-conductive state charges a capacitor C7; charging current flow being through the primary winding of a trigger transformer T2 which forms part of the flash tube package. Capacitor C7 and the primary winding of trigger transformer T2 form a series resonant circuit which rings negative when SCR-1 is initially gated into the conductive state thus affording capacitor C7 a discharge path to ground. The ringing of this series resonant circuit commutates SCR-1 during the transition from negative to positive potential. SCR-1 is also turned off as a consequence of its being starved for current since, upon discharge of capacitor C7, the high anode voltage will be reduced by the flash tube load thus, in turn, reducing the holding current for SCR-1.

The operation of SCR-2 in response to the application of a positive going pulse to its gate electrode is similar to that described above with respect to SCR-1. SCR-2 will be "fired" a short time after the firing of SCR-1; the delay being determined by the setting of timing circuit 26 and being of appropriate duration to permit the recharging of capacitors C3 and C4 to a level sufficient to provide a trigger pulse magnitude adaquate to ionize the flash tube 22. In this regard it is to be noted that the voltage divider consisting of resistors R13′ and R14′ associated with SCR-2 will be comprised of resistors having different values when compared to the voltage divider R13-R14 associated with SCR-1. Thus, the voltage divider consisting of resistors R13′ and R14′ will apply the required trigger voltage to the anode of SCR-2, and thus to capacitor C7′, at a time during the operational cycle when the high voltage supply capacitors C3 and C4 are not fully charged. With regard to the charging of capacitors C3 and C4, it is to be observed that the frequency of operation of the power supply blocking oscillator; i.e., the frequency of conversion of the static inverter is substantially greater than the output frequency of timer 26.

The circuit of FIG. 1 may also include means for energizing an audible warning device. This audible warning device is, in the embodiment of FIG. 1, an electro-mechanical noise maker 28 coupled, by means of an isolation capacitor C8 and a switch S-1, to the blocking oscillator side of primary winding 16 of transformer T1. Thus, presuming switch S-1 has been closed, the sound generating device will provide a "chirp" each time the switching transistors Q1 and Q2 are turned off. While the audible warning device obviously draws some power, there is insufficient current flow to ground through the noise maker to have a deleterious effect on the operation of the static inverter and thus the audible warning may be added to the flash lamp control circuit without any deleterious effect on the operation of the static inverter.

Figure 2:
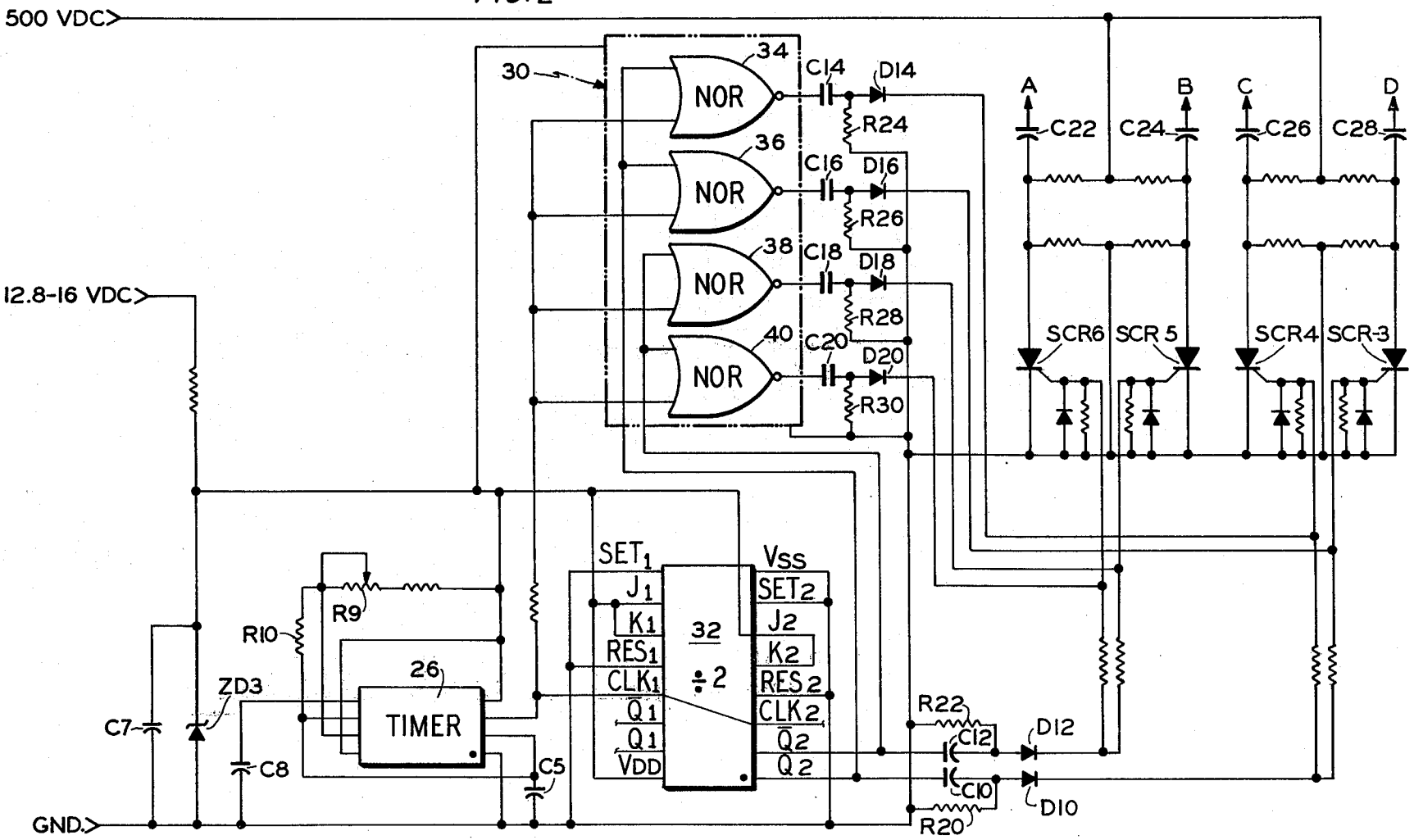
FIG. 2 is a partial schematic diagram of a second embodiment of the invention, the circuit of FIG. 2 being designed for energization of a plurality of flash tubes.

Referring now to FIG. 2, a modification of the logic and high voltage switching circuitry for use with the basic power supply of FIG. 1 is depicted. The trigger pulse generation circuitry depicted in FIG. 2 is utilized to generate trigger pulse pairs for application to two pair of flash tubes. It will, however be obvious to those skilled in the art that the circuit of FIG. 2 may be employed, either as shown or with slight modification, to control the operation of from two to four flash tubes and also to apply trigger pulses to such tubes in any desired sequence.

The FIG. 2 embodiment employs the adjustable timer 26; the timing adjustment circuitry and protective devices, including noise filters C7 and C8, for the timer being shown in somewhat more detail in FIG. 2. The unsymmetrical square wave output of timer 26 is delivered to a logic circuit indicated generally at 30 and to a divider circuit 32. Logic circuit 30, in the disclosed embodiment, is a quad NOR gate such as, for example, RCA type CD4001. The divide by two circuit 32 consists of a steering flip-flop and may, for example, comprise an RCA type CD4027AE. The $Q_2$ and $\overline{Q}_2$ outputs from the divider circuit 32 are also applied as inputs to the quad NOR gate 30.

Divider circuit 32 alternatively provides, on the $Q_2$ and $\overline{Q}_2$ outputs, positive pulses synchronized with the leading edge of alternate positive going output pulses of timer 26; i.e., the output signals from divider circuit 32 are positive pulses having a duration equal to a full cycle of the square wave output of timer 26. The $Q_2$ and $\overline{Q}_2$ outputs of divider circuit 32 are applied to RC differentiating circuits consisting respectively of resistor R20 in combination with capacitor C10 and resistor R22 in combination with capacitor C12. The positive going output pulses provided by the differentiator connected to the $Q_2$ output of timer 32 are coupled, via a diode D10, to the gate electrodes of silicon controlled rectifiers SCR-3 and SCR-4. Similarly the positive voltage spikes provided at the output of the differentiator associated with the $\overline{Q}_2$ output of timer 32 are coupled, via diode D12, to the gate electrodes of rectifiers SCR-5 and SCR-6. Diodes D10 and D12 are included in the circuit to prevent noise feedback from the switching circuit to divider 32.

As noted above, logic circuit 30 is a quad NOR gate; i.e., circuit 30 is an integrated circuit which includes NOR gates 34, 36, 38 and 40. These four NOR gates provide a positive output potential when both inputs thereto are at a zero level. As noted above, the square wave output of timer 26 is applied as a first input to each of gates 34, 36, 38 and 40. The $Q_2$ output of divider circuit 32 is applied as the second input to NOR gates 34 and 36 while the $\overline{Q}$ output of divider 32 is applied as the second input to NOR gates 38 and 40. Thus, the outputs of gates 34 and 36 will be synchronized with one another but not with the synchronized outputs of gates 38 and 40. The outputs of gates 38 and 40 will go positive in synchronism with the trailing edges of positive portions of every other cycle of the square wave output of timer 26; i.e., the outputs of NOR gates 38 and 40 will be positive when the output of timer 26 is at the zero level between positive pulses and the $\overline{Q}_2$ output of divider 32 is also at the zero level. Similarly, the outputs of NOR gates 34 and 36 will go positive in synchronism with the trailing edges of those timer output pulses which do not, because of the state of the divider 32, affect NOR gates 38 and 40. The outputs of NOR gates 34, 36, 38 and 40 are applied, via differentiator circuits and couplng diodes, respectively to the gate electrodes of rectifiers SCR-4, SCR-3, SCR-5 and SCR-6. Thus, a positive pulse commensurate with the output of NOR gate 34 going positive will be generated by the differentiator comprising resistor R24 and capacitor C14 and this pulse will be coupled via diode D14 to the gate electrode of silicon controlled rectifier SCR-4. Similarly and simultaneously, a positive pulse commensurate with the output of NOR gate 36 going positive will be generated by differentiator R26-C16 and coupled by diode D16 to the gate electrode of SCR-3. Positive pulses resulting from the gating of NOR gate 38 will be provided by differentiator R28-C18 and coupled by diode D18 to the gate of SCR-5 while positive pulses commensurate with the enabling of gate 40 will be provided by differentiator R30-C20 and coupled by diode D20 to the gate of SCR-6.

In the manner described above in the discussion of FIG. 1, trigger pulses for the firing of flash tubes are generated by "firing" the SCR's to thereby establish a discharge path for a capacitor connected in a series resonant circuit. Thus, the operation of silicon controlled rectifiers SCR-3, SCR-4, SCR-5 and SCR-6 is identical to that of SCR-2 of FIG. 1. The primary windings of the trigger pulse transformers for each of the four flash tubes are respectively connected at points A, B, C and D and FIG. 2 and capacitors C22, C24, C26 and C28 are in the separate series resonant circuits; these capacitors being charged from the high voltage source comprising series connected capacitors C3 and C4 of the power supply of FIG. 1.

In operation, the flash tubes connected at points A and B will be energized simultaneously and twice in rapid succession and the flash tubes connected at points C and D will thereafter be flashed simultaneously and twice in rapid succession; the delay between the generation of the second pulse of a trigger pulse pair for a first pair of lamps and the generation of the first trigger pulses for the other pair of lamps being commensurate with the time period the output of timer 26 is in the positive state. To be more specific, SCR-5 and SCR-6 will be simultaneously caused to conduct when the outputs of NOR gates 38 and 40 go positive. The SCR's will, in the manner described above in the discussion of FIG. 1, be commutated and will be biased into conduction a second time in response to the differentiated positive going $\overline{Q}_2$ output of timer 32. The time delay between successive simultaneous "firings" SCR-5 and SCR-6 will be determined by the "off" time of the timer 26. Thereafter, in the same manner, rectifier devices SCR-3 and SCR-4 will be turned on in response to the outputs of gates 34 and 36 going positive, these rectifier devices will be commutated and SCR-3 and SCR-4 will again be caused to conduct by the pulse commensurate with the $Q_2$ output of divider 32 going positive.

As noted above, it will be understood that the embodiment of FIG. 2 may be employed to provide any desired sequence of flash lamp energization. Thus, by way of example, the circuit of FIG. 2 could be employed to gate eight silicon controlled rectifiers for use in the generation of trigger pulses for four flash tubes. Alternatively, a pair of NOR gates and four silicon controlled rectifiers may be employed to generate pulse pairs for use in controlling a pair of flash tubes.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for controlling the energization of a warning light, the warning light including a gaseous discharge lamp with a trigger pulse transformer coupled thereto, said energization control apparatus comprising:

timer means, said timer means including a square wave generator and producing an output signal having two states, the square wave generator having an adjustable duty cycle;

static inverter means adapted to be supplied from a low voltage direct current source, said inverter means including an oscillator which generates an alternating voltage at a frequency greater than the frequency of said timer means square wave generator output signal, the output of said inverter means being a high DC voltage;

means coupling the high DC voltage produced by said static inverter means to said warning light gaseous discharge lamp;

capacitor means connected to a winding of the trigger pulse transformer of said warning light, said capacitor means cooperating with said pulse transformer winding to define a series resonant circuit;

means delivering the high output voltage produced by said static inverter means to said capacitor means;

normally open switch means, said switch means establishing a discharge path for said capacitor means when in the closed condition;

means responsive to each change in the level of the output signal of said timer means square wave generator for producing a switching control pulse for application to said switch means whereby said switch means is closed to permit discharge of said capacitor means with the resultant generation of a trigger pulse in said series resonant circuit;

means coupling the output signal of said timer means to said switching control pulse producing means; and means for delivering switching control pulses provided by said switching control pulse producing means to said normally open switch means.

2. The apparatus of claim 1 wherein said capacitor means includes at least a pair of capacitors and wherein said switch means includes:

a first solid state switch circuit connected to a first of said capacitors, said first switch circuit being responsive to switching control pulses of a first polarity; and at least a second solid state switch circuit connected to a second capacitor for providing a discharge path therefore, said second switch circuit being responsive to switching control pulses of a second polarity.

3. The apparatus of claim 2 wherein said means for producing switching control pulses includes:

differentiator means, said differentiator means providing short duration output pulses of a first polarity for delivery to said first switch circuit when the output of said square wave generator means changes in a first direction, sid differentiator means providing output pulses of a second polarity for delivery to said second switch circuit when the output of said square wave generator means varies in the second direction.

4. The apparatus of claim 1 wherein the warning lamp includes a plurality of flash tubes, each having an associated trigger pulse transformer, and wherein said switching control pulse producing means comprises:

divider means connected to the output of said timer means square wave generator means for providing a pair of asymmetric square waves at a frequency lower than the frequency of the output signal of said timer means;

at least first and second gate circuits;

means connecting the output of said timer means to a first input of each of said gate circuits;

means delivering the output signals from said divider means to respective of said gate circuits whereby said gate circuits will alternately provide output pulses synchronized with the portion of the timer means output signal of shorter duration;

means connected to the outputs of said gate circuits for generating switching pulses upon energization of said gate circuits;

means responsive to the output signals provided by said divider means for generating switching pulses upon upon the changing of state of said divider means output signals, the thus generated pulses defining two pair of switch control pulses with the pulses of each pair being spaced by a period commensurate with the time each gate circuit is energized; and means delivering said switch control pulses to said switch means.

5. The apparatus of claim 4 wherein said capacitor means includes a capacitor connected in series with a trigger transformer winding on each flash tube and wherein said switch means includes;

a normally non-conductive semi-conductor device connected in series with each of said capacitors.

6. The apparatus of claim 1 wherein said static inverter means oscillator is in series with the primary winding of a step-up transformer and wherein said apparatus further comprises:

sound generating means capactively coupled to said step-up transformer primary winding, said sound generating means being periodically energized at the frequency of operation of said static inverter means oscillator.

7. The apparatus of claim 3 wherein said static inverter means oscillator is in series with the primary winding of a step-up transformer and wherein said apparatus further comprises:

sound generating means capacitively coupled to said step-up transformer primary winding, said sound generating means being periodically energized at the frequency of operation of said static inverter means oscillator.

8. The apparatus of claim 5 wherein said static inverter means oscillator is in series with the primary winding of a step-up transformer and wherein said apparatus further comprises:

sound generating means capacitively coupled to said step-up transformer primary winding, said sound generating means being periodically energized at the frequency of operation of said static inverter means oscillator.

* * * * *